US005937870A

United States Patent [19]

Gueret

[11] Patent Number: 5,937,870

[45] Date of Patent: Aug. 17, 1999

[54] BRUSH FOR APPLYING A COSMETIC PRODUCT AND MAKE-UP DEVICE COMPRISING IT

[75] Inventor: Jean-Louis H. Gueret, Paris, France

[73] Assignee: L'Oreal, Paris, France

[21] Appl. No.: 08/933,278

[22] Filed: Sep. 18, 1997

[30] Foreign Application Priority Data

Sep. 26, 1996 [FR] France ..... 96 11752

[51] Int. Cl.[6] ..... A45D 40/26

[52] U.S. Cl. ..... 132/218; 132/320

[58] Field of Search ..... 132/218, 216, 132/217, 313, 317, 320; 15/206, DIG. 5

[56] References Cited

U.S. PATENT DOCUMENTS

| | | | |
|---|---|---|---|
| 1,806,520 | 5/1931 | Cave | 15/206 |
| 4,458,701 | 7/1984 | Holland | 132/218 |
| 4,527,575 | 7/1985 | Vasas . | |
| 5,137,038 | 8/1992 | Kingsford . | |
| 5,357,987 | 10/1994 | Schrepf . | |
| 5,418,999 | 5/1995 | Smith | 15/206 |
| 5,542,439 | 8/1996 | Gueret | 132/218 |
| 5,551,456 | 9/1996 | Hartel | 132/318 |

FOREIGN PATENT DOCUMENTS

| | | |
|---|---|---|
| 0 663 161 A1 | 7/1995 | European Pat. Off. . |
| 726157 | 5/1932 | France . |
| 2 730 910 | 8/1996 | France . |
| 42 05 935 A1 | 9/1993 | Germany . |

*Primary Examiner*—Todd E. Manahan
*Assistant Examiner*—Eduardo C. Robert
*Attorney, Agent, or Firm*—Oblon, Spivak, McClelland, Maier & Neustadt, P.C.

[57] ABSTRACT

A brush which includes a straight wand defining a major axis; a flexible core which defines the length of the brush, the core including a first end and a second end, the first end being secured to the wand. A plurality of bristles are inserted radially into this core, the end of the bristles defining an envelope surface of the brush, the envelope surface having a first end and a second end, wherein the core is curved in a plane of curvature and the envelope surface of the brush over at least part of its length has a cross-section of elongate shape in the direction of an axis of greatest length perpendicular to the plane of curvature.

19 Claims, 5 Drawing Sheets

BRUSH FOR APPLYING A COSMETIC PRODUCT AND MAKE-UP DEVICE COMPRISING IT

BACKGROUND OF THE INVENTION

1. Field of the Invention

The invention relates to a brush, particularly a brush for applying the cosmetic product to keratinous fibers, especially for applying mascara to the eyelashes or a dye to the hair, and to a make-up device comprising this brush, the brush having a curved core.

2. Discussion of the Background

A brush for applying a cosmetic product customarily comprises an elongate core, formed by a helical twist of two branches of a metal wire which has been bent into a U before the branches were twisted, and bristles inserted radially into this core and gripped between these twisted branches. Such brushes may be of various shapes and have cutouts.

When these brushes are used to apply mascara to the eyelashes, such shapes and such cutouts are designed to make it up possible to obtain a heavier or lighter make-up effect, with varying amounts of lengthening and of curling of the eyelashes.

Brushes in the shape of a fragment of a torus are known, these brushes being obtained by twisting the core of a cylindrical brush into an arc of a circle. Such brushes have a convex face, a concave face, and two more or less flat faces. Such brushes are not very easy to handle because if the user twists the wand of such a brush about its axis between her fingers in order, for example, to apply a product to her eyelashes, she has to continually correct the distance between the brush and the eyelashes. With these brushes, it is difficult to apply make-up in the comer of the eye without overspill onto the eyelid and the side of the nose. Furthermore, it has been observed that such a brush tends to coat the eyelashes without spreading the product out very much. Brushes obtained by twisting the core of a cylindro-conical brush into a circular arc display the same drawbacks.

SUMMARY OF THE INVENTION

It has therefore become desirable to have use of brushes that allow the eyelashes to be engaged fully by the brush in order to spread out the product correctly and separate the lashes properly. Another object of the invention is to provide a brush which is still simple and economical to apply and practical to use.

The present invention is based on the discovery of novel brushes for applying a cosmetic product which, when used to apply mascara to the eyelashes, make it possible to obtain a make-up effect with a great deal of curling and lengthening and with a product spread out along the entire length of the lash. These brushes are, moreover, very easy to handle and allow make-up to be applied with ease to the corner of the eye.

An object of the invention is to provide a brush comprising a straight wand defining a major axis (X—X); a flexible core which defines the length of the brush, this core comprising a first end and a second end, the first end being secured to the wand; a plurality of bristles inserted radially into this core, the end of the bristles defining an envelope surface of the brush, this envelope surface having a first end and a second end, the brush being characterized in that the core describes a curve (C) in a plane of curvature (P) and in that the envelope surface of the brush over at least part of its length has a cross section of elongate shape in the direction of an axis of greatest length (Z—Z) perpendicular to the plane of curvature (P).

The cross-section of the envelope surface is intended to mean a section through the envelope surface on a plane perpendicular to the core.

Preferably the curve (C) is more or less circular. That part of the brush which is in the concave part f the curve (C) forms a hollow. That part of the brush which is on the opposite side forms the back of the brush. As the cross-sections of the envelope surface of the brush are elongate, in the direction of the axis of greatest length, in the direction perpendicular to the plane (P) of twisting of the core, the brush according to the invention has two broad flattened faces, one being in the hollow of the brush and the other in the back of the brush. The face that is in the hollow of the brush is very close in shape to the contour of the eyelashes. Furthermore, it contains short and therefore not very flexible bristles. It can therefore engage the eyelashes along the entire width of the eyelid, coat them with product, lengthen them and curl them. As the distance between the two faces is shorter than the width of the brush, the brush can slip easily into the comer of the eye to apply make-up to the eyelashes without overspill around the comer of the eye. The sides of the brush, which have longer, and therefore more flexible, bristles than the faces, but which are not as wide, give very effective combing and separation of the lashes. The back of the brush, just like the hollow, allows the make-up or care product to spread by engaging the lash over a significant portion of the length of the lash. As this back is domed, it encourages the curling of the lash.

The very pronounced and markedly differing characteristics of the faces and of the sides give this brush a surprising dynamic behavior. When the user turns the brush between her fingers, the lashes are alternately coated and curled, then combed out with uncustomary intensity.

Preferably, the core is central with respect to each cross-section.

In a first alternative form of the invention, provision may be made for the cross-section to have at least two sides in the direction of the axis of greatest length (Z—Z), these sides being more or less parallel to the axis (Z—Z).

In a second alternative form of the invention, provision may be made for the cross section to have at least two sides in the direction of the axis of greatest length (Z—Z), these sides having a convex shape. According to this alternative form, provision may be made for the sides of the cross section to have two ends, the width of the section in the direction of the axis (Y—Y) perpendicular to the axis of greatest length (Z—Z) at these ends being more or less zero.

Irrespective of the alternative form of the invention, it is preferable for the cross-section to have at least two sides in the direction of the axis (Y—Y), this axis being perpendicular to the axis of greatest length (Z—Z), these sides having a convex shape.

Advantageously, the cross -section has a maximum width (D) in the direction of the axis of greatest length (Z—Z) and a maximum width (d) in the direction of the axis (Y—Y), widths D and d satisfying the relationship:

$$D>1.5d$$

More preferably still, D and d satisfy the relationship:

$$D>2d$$

The longer length D can vary along the core. In order to make the make-up characteristics described hereinabove more pronounced, brushes in which the envelope surface has an elongate cross section over at least 50% and preferably 75% of its length are preferred.

Advantageously, the brushes according to the invention are designed in such a way that, for each cross section, the axis of greatest length and the axis of greatest width are perpendicular.

For greater ease of handling, provision is preferably made for the ends of the core to be aligned with the axis X—X.

Another object of the invention is to provide a method of manufacturing a brush as described hereinabove, the method being characterized in that it comprises the following steps:

(i) producing a starting brush comprising a straight wand defining a major axis (X—X); a flexible core which defines the length of the brush, this core comprising a first end and a second end, the first end being secured to this wand, the core being straight and aligned with the wand, the bristles thereof being inserted radially into this core with the end of the bristles defining an envelope surface of the starting brush.

(ii) trimming the bristles of the starting brush in such a way that the envelope surface of the brush over at least part of its length has a cross section of elongate shape in the direction of an axis of greatest length (Z—Z), (iii) giving the core a main twist in the plane perpendicular to the axis of greatest length (Z—Z) and passing through the wand.

Preferably, in a fourth step:

(iv) a secondary twist is given to that end of the core which is secured to the wand in order to align the second end of the core with the main axis (X—X).

Steps (i) and (ii) are preferably carried out in such a way that the core is central with respect to the faces of the straight trimmed brush.

The starting brush is preferably trimmed in such a way that the envelope surface has an elongate cross-section over at least 50% and preferably 75% of its length.

In a preferred embodiment of the invention, step (iii) is carried out in such a way as to give the core a more or less circular main twist.

Furthermore, the bristles of the brushes according to the invention may be of any kind: bristles of different lengths, of different diameters or of different sections and of different materials, bristles with tapered ends, with forked ends, or shaped like a hairpin, or bristles that have undergone any sort of treatment known to those skilled in the art.

Provision may also be made for the brush according to the invention to contain alternating rows of short bristles and of long bristles, only the long bristles being involved in defining the envelope surface of the brush. This kind of alternative form of the invention makes it possible to accentuate the coating of the eyelash with product by the brush of the invention.

The helical twisting of the two branches of metal wire that forms the core may be with a right-hand twist as is customarily practiced in the manufacture of make-up brushes, or with a left-hand twist, as per the teachings of French patent application 2701198. To manufacture a brush with a left-hand twist, the branches of the core are twisted by turning to the left to form turns that turn in the clockwise direction about the core in a direction from the wand towards the end of the brush.

Another object of the invention is to provide a make-up device comprising a mascara reservoir and a mascara-applicator member as described hereinabove.

Owing to its special shape, when the brush passes through a wringing device, its sides are very well wrung out, while its faces are wrung out to a lesser extent. In particular, the faces are wrung asymmetrically on account of their curvature. This special feature allows the user, depending on which of the faces she uses, to apply make-up with a heaviness and intensity that can vary along the entire length of the eyelid.

The flexibility of the bristles and the flexibility of the core can be altered to encourage or discourage wringing-out of the brush.

BRIEF DESCRIPTION OF THE DRAWINGS

In order to make the subject-matter of the invention easier to understand, several brushes that have the characteristics of this invention will be described hereafter by way of example.

FIG. 1E is a view which the result of a rotation of FIG. 1D through 90° about the axis X—X.

DESCRIPTION OF THE PREFERRED EMBODIMENTS

Figure 1:
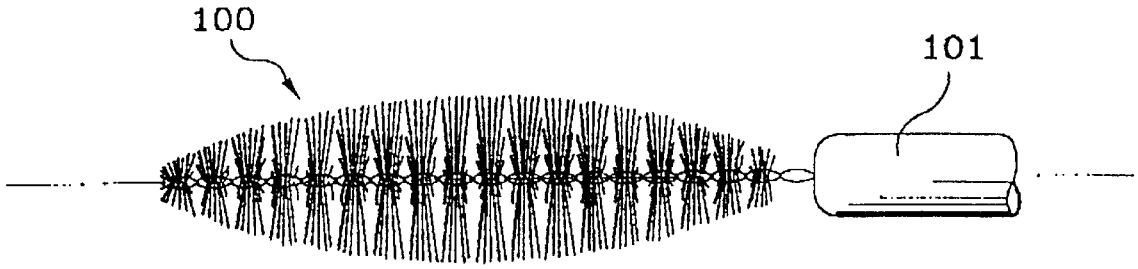
FIGS. 1, 1A and 2A are perspective views of brushes that can be used to manufacture a brush according to the invention.
Figure 1A:
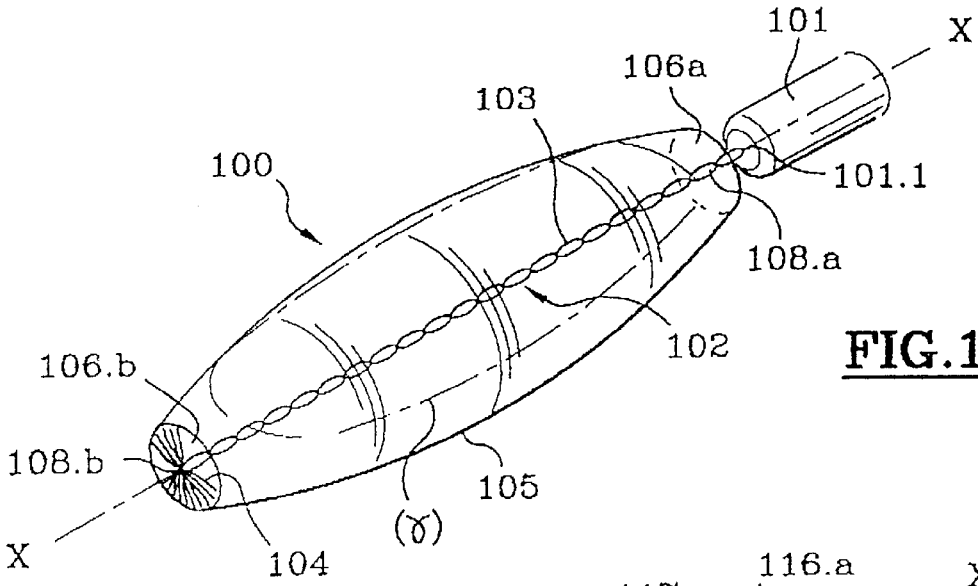

The brush 100 depicted in FIGS. 1 and 1A comprises a straight wand 101 defining a main axis X—X. Fixed by force-fitting to the end 101.1 of this wand 101 is a core 102 (which has been depicted in these figures even though it is inside the brush) which is elongate, formed by the helical twisting of two branches of a metal wire 103 which has been bent into a U before the branches were twisted. The axis of the core 102 coincides with the main axis X—X. Bristles 104 are inserted radially between the branches of the wire 103. When the branches of the wire 103 are twisted, the bristles are clamped and held between the helical turns of the core 102. The ends of the bristles 104 define the surface 105 of the brush. This is a convex axisymmetric surface which has the shape of a rugby ball and the ends of which consist of two right cross-sections: the disk 106.*a* with a center 108.*a* and the disk 106.*b* with a center 108.*b*.

Using a trimmer, two more or less flat parallel faces are cut in the brush of FIG. 1A over practically the entire length (measured along the axis X—X) of the brush. Depicted in FIG. 1A is the intersection (γ) between the surface 105 of the brush and the trimming plane. This yields a trimmed brush depicted in FIGS. 1B and 1C.

Figure 1B:
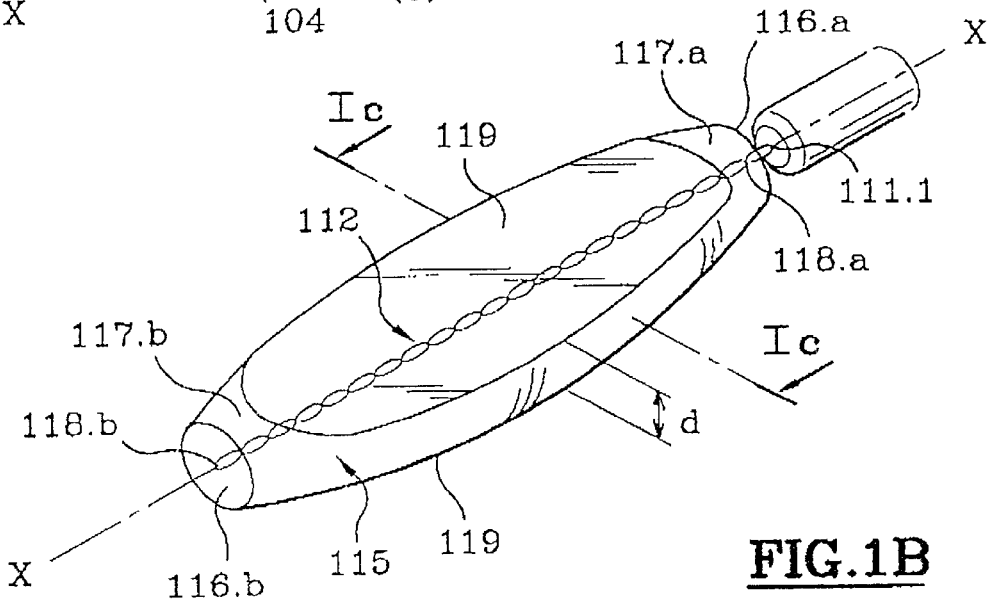
FIGS. 1B and 2B are perspective views of brushes, respectively, according to 1A and 2A which have been trimmed in accordance with step (ii) of the method according to the invention.
Figure 1C:
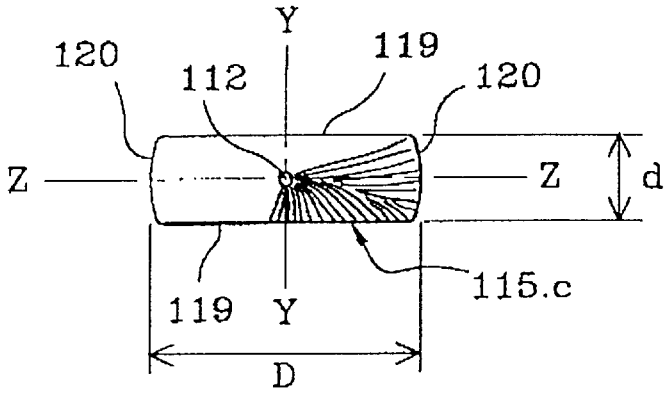
FIGS. 1C and 2C are sectional view taken along on planes IC—IC and IIC—IIC of the brushes depicted in FIGS. 1B and 2B respectively.

For elements of FIGS. 1B and 1C which are common to those of FIG. 1A, the reference numbers in FIGS. 1B and 1C are the same as those in FIG. 1A, increased by 10.

The brush depicted in FIGS. 1B and 1C has two mutually parallel faces 119 which are also parallel to the axis X—X. These two faces are equidistant from the core 112. The distance between the two faces is represented by the symbol d. The two faces are joined by rounded edges 120. In the region where the faces 119 have cutouts, the sections of the brush on a plane perpendicular to X—X consist of curves 115C depicted in FIG. 1C which are more or less rectangular, with a long length D in the direction of the axis of greatest length Z—Z and the greatest width d measured along the axis of greatest width Y—Y with D>1.5d. The two faces do not extend as far as the ends 117*a* and 117*b* of the brush. At these ends, the sections 116*a,* 116*b* of the brush are circular wherein a width dimension of a cross-section in the direction of an axis perpendicular to the axis X—X at these ends is substantially zero. The curve 115C is symmetric with respect to the axis of greatest length Z—Z and the axis of greatest width Y—Y.

Using an appropriate tool, for example by pressing the core longitudinally around a metal cylinder, the core 112 is given a first twist in the plane perpendicular to the faces 119 between the sections 116.*a* and 116.*b,* in such a way that the core has more or less the shape of an arc of a circle, and then it is given a second twist, in the same plane, between the end 111.1 of the wand and the center 118.*a* of the end section of the brush, so as to align the center 118.*b* of the other end of the brush with the main axis X—X, like the first end 118.*a.*

Figure 1D:
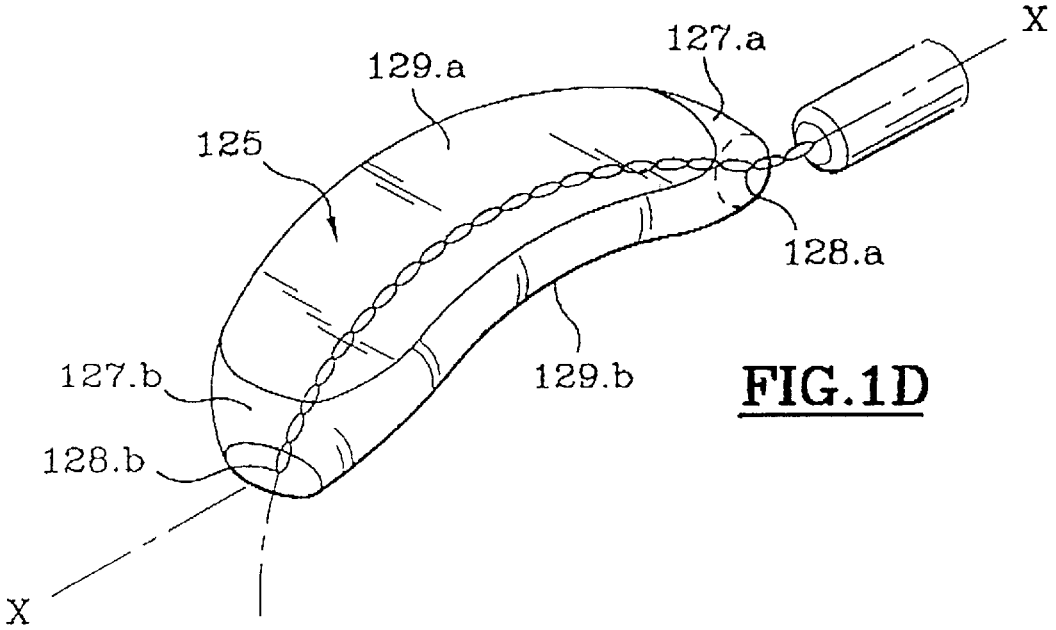
FIGS. 1D, 1E and 2D are perspective views of brushes according to the invention, manufactured in accordance with the method according to the invention, from the brushes depicted in FIGS. 1A and 2A respectively.
Figure 1E:
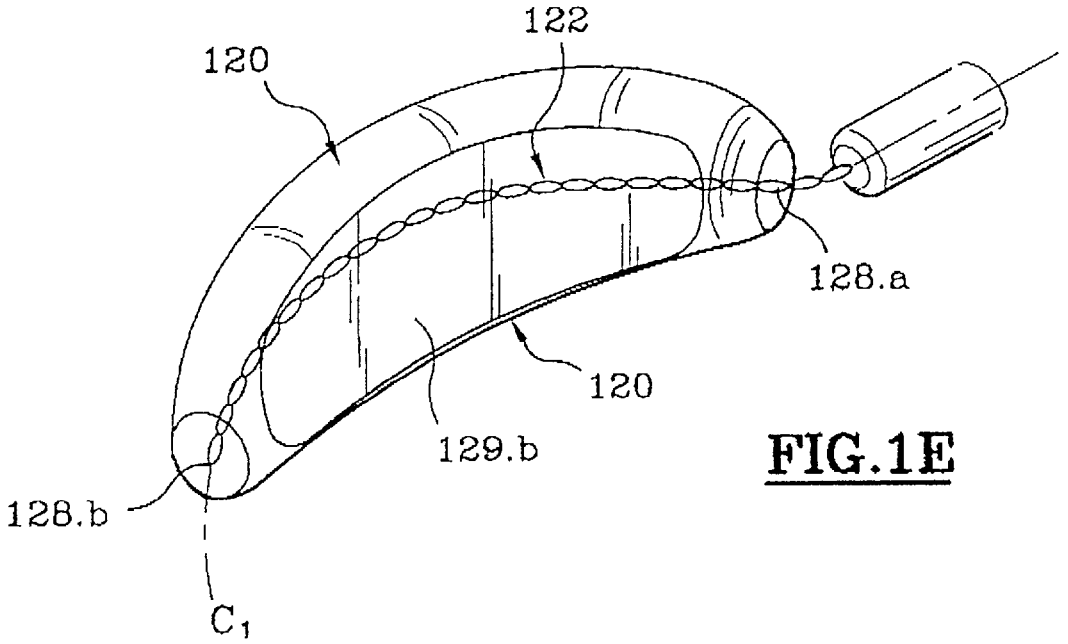

This operation yields a brush 120 according to the invention and depicted in FIGS. 1D and 1E. In these figures, the reference numbers given to elements which are similar to those in FIGS. 1B and 1C are those of FIGS. 1B and 1C increased by 10.

The brush in FIGS. 1D and 1E is more or less in the shape of an elongate spoon. The core 122 describes a curve $C_1$ which is more or less an arc of a circle. However, its ends 128.*a* and 128.*b* are aligned with the main axis X—X. The brush comprises two faces 129*a,* 129*b,* one of them, 129*a,* forming the back and the other face, 129*b,* forming the hollow bowl of the spoon. These two faces are joined by rounded edges 120. The surface 125 of the brush is generated by a series of curves 115*c,* as depicted in FIG. 1C, which progress along the core 122. These curves are more or less rectangular, with their axes of greatest length (Z—Z) being mutually parallel. At its ends 127*a,* 127*b,* the brush is generated by circular curves.

Figure 2A:
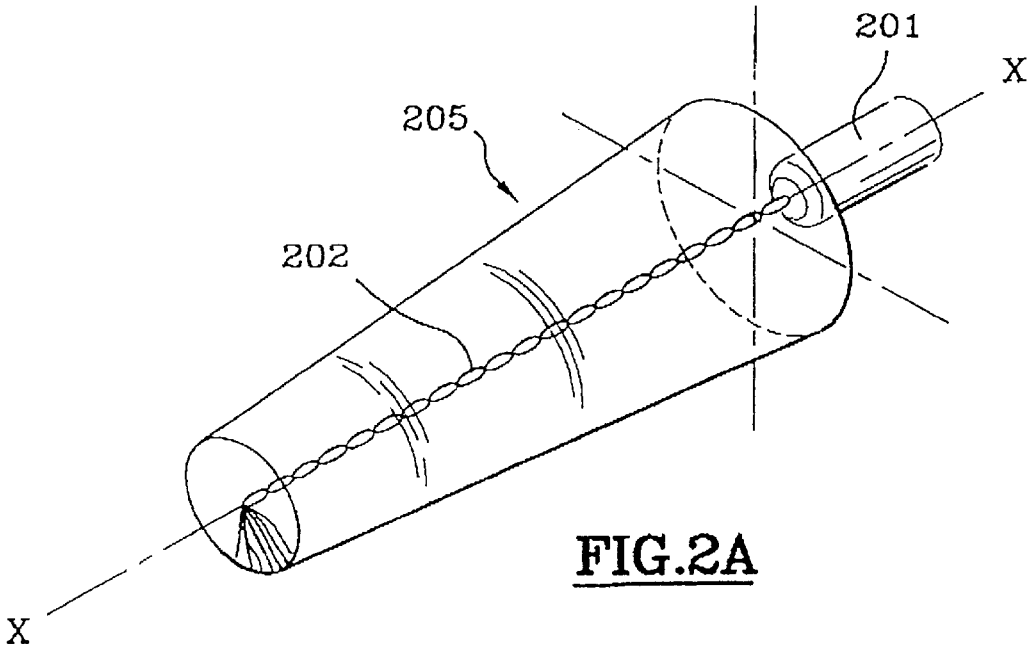

FIG. 2A is differentiated from FIG. 1A by the fact that the surface 205 of the starting brush is in the shape of a cone frustum.

Using a trimmer, two secant rounded faces are cut in the brush of FIG. 2A along the entire length (measured along the axis X—X) of the brush. This yields a trimmed brush depicted in FIGS. 2B and 2C.

Figure 2B:
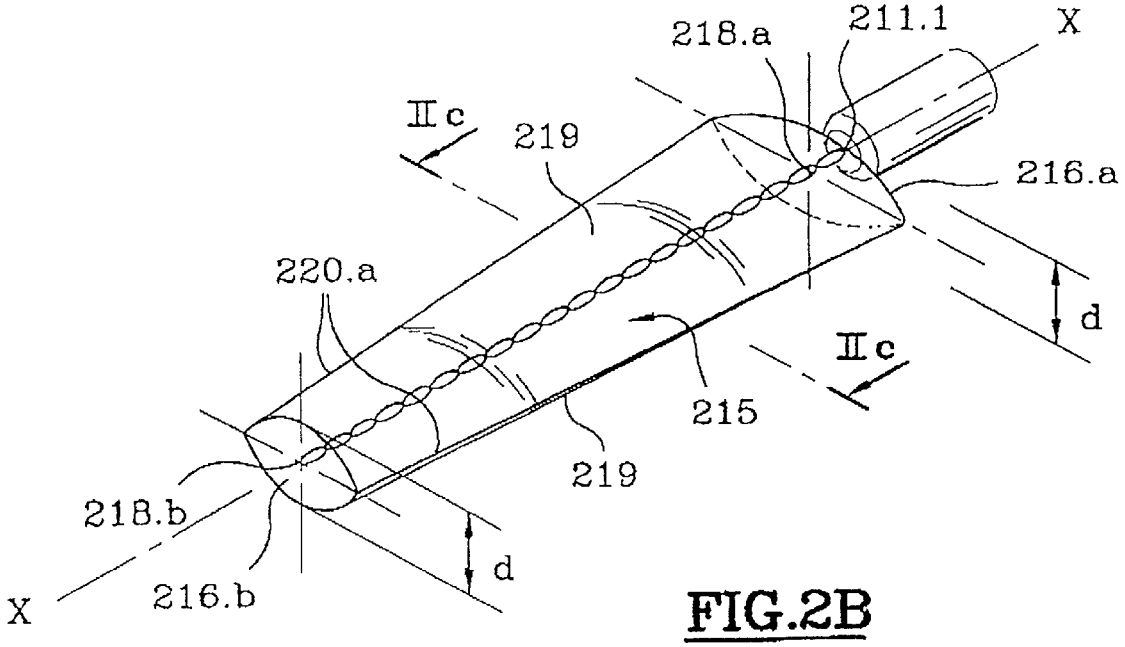
Figure 2C:
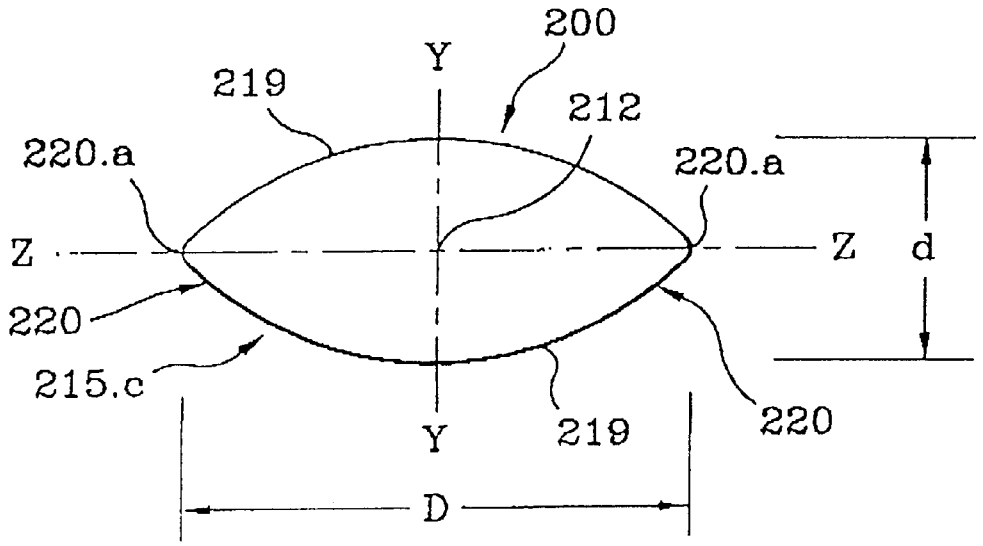

For elements of FIGS. 2B and 2C which are common to FIG. 2A, the reference numbers in FIGS. 2B and 2C are the same as those in FIG. 2A increased by 10.

The brush depicted in FIGS. 2B and 2C has two rounded and secant faces 219. These two faces are symmetric with respect to the core 212. The width between the extremes of the two faces is represented by symbol d. Width d is more or less constant from one end of the brush to the other. The two faces are joined by edges 220 which end in ridges 220*a.* The sections of the brush on a plane perpendicular to X—X consist of curves 215*c* depicted in FIG. 2C which are more or less eye-shaped, with the long length D along the axis of greatest length Z—Z and greatest width d measured along the axis of greatest width Y—Y. D increases from a first end 216*b* as far as a second end 216*a* with D>2d on the curve 215*c* depicted in FIG. 2C. The two trimmed faces extend as far as the end sections 216*a* and 216*b* of the brush. The curve 215*c* is symmetric with respect to the axis of greatest length Z—Z and the axis of greatest width Y—Y.

Using an appropriate tool, for example by pressing the core longitudinally around a metal cylinder, the core 212 is given a first twist in the plane perpendicular to the faces 219 between the sections 216.*a* and 216.*b,* in such a way that the core has more or less the shape of an arc of a circle, and is then given a second twist, in the same plane, between the end 211.1 of the wand and the center 218.*a* of the end section of the brush, so as to align the center 218.*b* of the other end of the brush with the main axis X—X, like the first end 218.*a.*

Figure 2D:
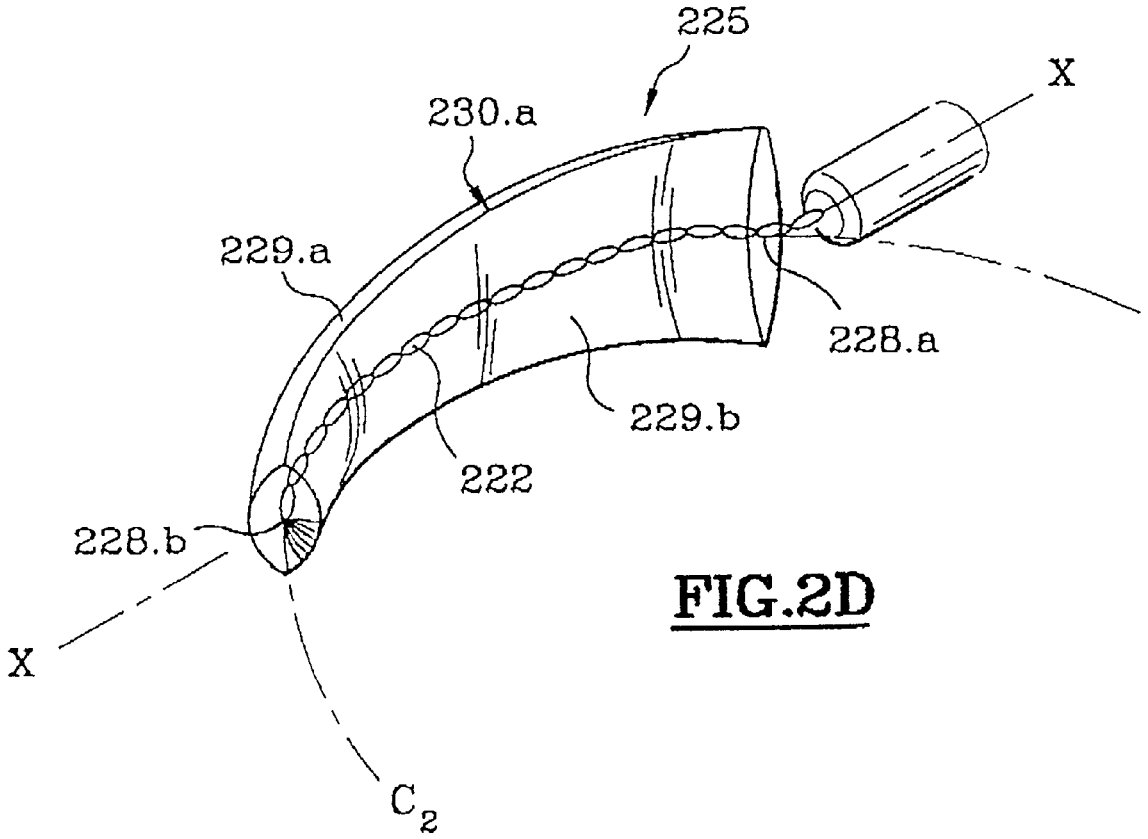

This operation yields a brush 200 according to the invention and depicted in FIG. 2D. In this figure, the reference numbers given to elements that are similar to those in FIGS. 2B and 2C are those of FIGS. 2B and 2C increased by 10.

The brush in FIG. 2D is more or less in the shape of an elongate spoon; the core 222 describes a curve $C_2$ which is more or less an arc of a circle. However, its ends 228.*a* and 228.*b* are aligned with the main axis X—X. The surface 225 of the brush comprises two faces 229*a,* 229*b,* one of them, 229*a,* forming the back and the other, 229*b,* forming the hollow bowl of the spoon. These two faces are joined by a ridge 230*a.* The surface 225 of the brush is generated by a series of curves 215 as depicted in FIG. 2C, which progress along the core 222. These curves are more or less eye-shaped, with their axes of greatest length (Z—Z) mutually parallel.

In the two embodiments of the invention described hereinabove, use was made of starting brushes with the shape of a rugby ball and a frustoconical shape, but it is also possible to use an elongate starting brush with a shape chosen from: a cylinder, two cones joined together by the bases of the two identically-sized cones, a fish as described for example in the French patent application FR-A-2730910, a peanut, an obus (shell shaped) or a teardrop.

Figure 3:
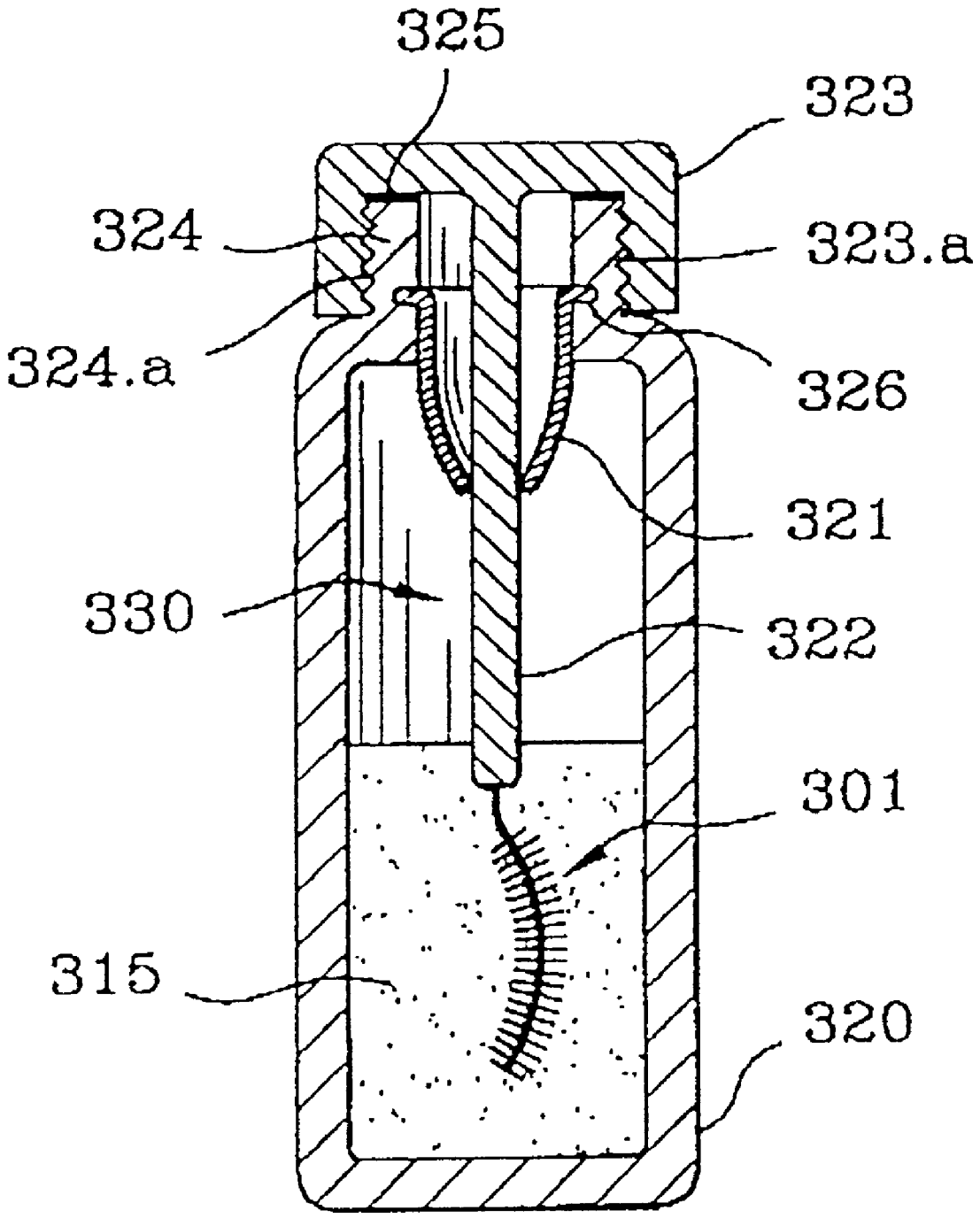
FIG. 3 is a view in section of a device for applying make-up to the eyes.

The device for applying make-up to the eyes depicted in FIG. 3 comprises a cylindrical reservoir 320 which has a threaded neck 324 surmounted by a seal 325 and which is full of a mascara 315. In its neck, the reservoir 320 has a wringing device 321, the wringing device being held in position in the neck by a rim 326 that interacts with the shoulder separating the neck from the reservoir 320 proper. The wringing device 321 consists, in a known manner, of a flexible and elastic material. An applicator is intended to interact with the reservoir 320. This applicator consists of means 323 for holding which supports the applicator member 330, comprising a wand 322 and an applicator member 301 which are identical to those depicted in FIGS. 1D or 2D. The means 323 for holding is in the form of a cap and has a screw thread 323*a* which interacts with the screw thread 324*a* on the neck of the reservoir. The reservoir 320 can be closed and sealed by screwing the means 323 holding onto the neck 324 of the reservoir provided with its seal 325.

When the applicator member 330 is pulled out of the reservoir, the applicator member which is in the form of a brush laden with mascara passes through the wringing device 321. The latter wrings out the bristles on the back of the brush more than it wrings out the bristles in the hollow of the brush. The bristles on the sides of the brush are very much wrung out.

While applying the mascara to the eyelashes, the brush coats the lashes with product on both faces, then spreads out the product, lengthens and curls the lash with its back and hollow faces, and combs using its sides. As the bristles on the sides are very long compared with the rest of the bristles of the brush and the comb is not very thick, the lashes are engaged very well during this combing-out, which is very effective.

Compared with the brushes known from the prior art that are convex overall, the brush according to the invention offers the advantages of being very easy to use, of applying make-up to all of the hairs on the eyelid without overspill, and of providing a very lengthening and very curling make-up effect with good separation.

What is claimed as new and desired to be secured by Letters Patent of the United States is:

1. A brush comprising:

a wand defining a major axis;

a flexible core which defines the length of the brush, said core having a first end and a second end the first end being secured to the wand;

a plurality of bristles inserted radially into said core, the bristles having ends defining an envelope surface of the brush, said envelope surface having a first end and a second end, wherein the envelope surface of the brush has, over at least part of a length thereof, a cross-section of elongate shape in a direction of an axis of greatest length perpendicular to the major axis, the core has a curve in a plane perpendicular to said axis of greatest length and wherein said bristles form an exposed, concave hollow portion and an exposed, domed back portion to assist in spreading of a product which is placeable in said bristles of said hollow portion and said back portion.

2. A brush according to the claim 1, wherein the cross section of the envelope surface has at least two sides in the direction of the axis of greatest length, said sides being substantially parallel to the axis.

3. A brush according to claim 1, wherein the cross section of the envelope surface has at least two sides in the direction of the axis of greatest length, said sides having a convex shape.

4. A brush according to claim 3, wherein the sides of the cross section have two ends and wherein a width dimension of the section in the direction of an axis perpendicular to the axis of greatest length at these ends is substantially zero.

5. A brush according to claim 1, wherein the cross section of the envelope surface has at least two sides in the direction of an axis which is perpendicular to the axis of greatest length, said at least two sides having a convex shape.

6. A brush according to claim 1, wherein the cross section has a first maximum width D in the direction of the axis of greatest length and a second maximum width d in the direction of an axis which is perpendicular to the axis of greatest length, said first width D and second width d satisfying the relationship:

$$D>1.5d.$$

7. A brush according to claim 6, wherein first width D and second width d satisfy the relationship:

$$D>2d.$$

8. A brush according to claim 1, wherein said envelope surface has an elongate cross section over at least 50% of a length portion thereof.

9. A brush according to claim 1, wherein the envelope surface has an elongate section over at least 75% of a length portion thereof.

10. A brush according to claim 1, wherein the cross section of the envelope surface is substantially in the shape of an arc of a circle at end portions of said envelope surface.

11. A brush according to claim 1, wherein the curve is substantially circular.

12. A brush according to claim 1, wherein the ends of the core are aligned with a major axis of said wand.

13. Method of manufacturing a brush, which comprises:

producing a starting brush comprising a straight wand defining a major axis, a flexible core which defines a length dimension of the brush, said core comprising a first end and a second end, the first end being secured to said wand, the core being straight and aligned with the wand, a plurality of bristles being inserted radially into this core, and an end of the bristles defining an envelope surface of the starting brush, trimming the bristles of the starting brush in such a way that the envelope surface of the brush over at least part of a length thereof has a cross-section of an elongate shape in a direction of an axis of greatest length perpendicular to the major axis, and giving the core a main twist in a plane perpendicular to the axis of greatest length so as to have a curve in said plane perpendicular to the axis of greatest length and passing through the wand so as to form an exposed, concave hollow portion and an exposed, domed back portion to assist in spreading of a product which is placeable in said bristles of said hollow portion and said back portion.

14. A method according to claim 13, which comprises:

giving a secondary twist to an end of the core which is secured to the wand so as to align the second end of the core with the main axis.

15. A method according to claims 13 or 14, which comprises forming the envelope surface of the starting brush so as to be axisymmetric.

16. Method according to claim 13, which comprises forming the envelope surface of the starting brush so as to have an elongate shape.

17. Method according to claim 13, which comprises forming the surface of the starting brush so as to be convex.

18. Make-up device comprising:

a mascara reservoir and a mascara-applicator member, said applicator member comprising:

a straight wand defining a major axis;

a flexible core which defines a length of the brush, said core having a first end and a second end, the first end being secured to the wand;

a plurality of bristles inserted radially into said core, the bristles having ends defining an envelope surface of the brush, said envelope surface having a first end and a second end, wherein the envelope surface of the brush has, over at least part of a length thereof, a cross-section of elongate shape in a direction of an axis of greatest length perpendicular to the major axis, and intersecting said core, the core having a curve in a plane perpendicular to said axis of greatest length.

19. A brush for the application of a cosmetic product on keratinous fibers, comprising:

a wand defining a major axis;

a flexible core which defines the length of the brush, said core having a first end and a second end, the first end being secured to the wand;

a plurality of bristles radially inserted into said core, the bristles having ends defining an envelope surface of the brush, wherein the envelope surface of the brush has, over at least part of a length thereof, a cross-section of elongate shape in a direction of an axis of greatest length perpendicular to the major axis, and intersecting said core, the core having a curve in a plane perpendicular to said axis of greatest length.

* * * * *

UNITED STATES PATENT AND TRADEMARK OFFICE

CERTIFICATE OF CORRECTION

PATENT NO. : 5,937,870

DATED : August 17, 1999

INVENTOR(S): Jean-Louis H. GUERET

It is certified that an error appears in the above-identified patent and that said Letters Patent is hereby corrected as shown below:

Col. 1, line 67, change "cross section" to read --cross-section--.

Col. 2, line 43, change "cross section" to read --cross-section--.

Col. 3, line 2, change "cross section" to read --cross-section--.

Col. 3, line 5, change "cross section" to read --cross-section--.

Col. 3, line 5, change "cross section" to read --cross-section--.

Col. 3, line 23, change "cross section" to read --cross-section--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*